US012013214B2

(12) United States Patent
Petrovic et al.

(10) Patent No.: US 12,013,214 B2
(45) Date of Patent: Jun. 18, 2024

(54) BARRIER FOR A DEPLOYMENT UNIT OF A CONDUCTED ELECTRICAL WEAPON

(71) Applicant: Axon Enterprise, Inc., Scottsdale, AZ (US)

(72) Inventors: Aleksander Petrovic, Phoenix, AZ (US); Albert K. Lavin, Scottsdale, AZ (US); Magne H. Nerheim, Paradise Valley, AZ (US); Milan Cerovic, Scottsdale, AZ (US)

(73) Assignee: Axon Enterprise, Inc., Scottsdale, AZ (US)

( * ) Notice: Subject to any disclaimer, the term of this patent is extended or adjusted under 35 U.S.C. 154(b) by 100 days.

(21) Appl. No.: 17/745,642

(22) Filed: May 16, 2022

(65) Prior Publication Data

US 2022/0276027 A1 Sep. 1, 2022

Related U.S. Application Data

(63) Continuation of application No. 16/917,137, filed on Jun. 30, 2020, now Pat. No. 11,346,639, which is a (Continued)

(51) Int. Cl.
*F41H 13/00* (2006.01)

(52) U.S. Cl.
CPC ..... *F41H 13/0025* (2013.01)

(58) Field of Classification Search
CPC ..... F41H 13/0025; F41H 13/0012; F41H 13/0018; F41H 13/0031
(Continued)

(56) References Cited

U.S. PATENT DOCUMENTS 4,150,266 A 4/1979 Patrichi et al.
7,891,128 B2 * 2/2011 Brundula ..... F41H 13/0025 361/232
(Continued)

FOREIGN PATENT DOCUMENTS

CN 203053306 U 7/2013
KR 101573487 B1 12/2015
(Continued)

OTHER PUBLICATIONS

Taiwan Patent Office, Taiwan Office Action and Search Report for Taiwan Patent Application No. 106127344 dated May 15, 2018.
(Continued)

*Primary Examiner* — Jared Fureman
*Assistant Examiner* — Nicolas Bellido
(74) *Attorney, Agent, or Firm* — Justin Powley

(57) ABSTRACT

A deployment unit for use with a handle of a conducted electrical weapon ("CEW"). The deployment unit includes wire-tethered electrodes for launching toward a human or animal target for providing a current through the target to impede locomotion of the target. The deployment unit includes a barrier that prior to use with the handle protects the deployment unit from electrostatic discharge. Prior to use of the deployment unit, the barrier may further protect the deployment unit from ingress of dirt and/or moisture into the deployment unit. While the deployment unit is inserted into a handle, the barrier shields conductors of the handle and the deployment unit to facilitate delivery of a launch signal from the handle to the deployment unit to launch the wire-tethered electrodes.

26 Claims, 9 Drawing Sheets

Related U.S. Application Data continuation of application No. 15/657,909, filed on Jul. 24, 2017, now Pat. No. 10,731,953.

(60) Provisional application No. 62/478,710, filed on Mar. 30, 2017.

(58) Field of Classification Search
USPC ..... 361/232; 124/74, 58
See application file for complete search history.

(56) References Cited

U.S. PATENT DOCUMENTS

| | | | | |
|---|---|---|---|---|
| 9,080,840 | B2 | 7/2015 | Klug et al. | |
| 10,288,388 | B1 | 5/2019 | Lavin et al. | |
| 10,731,953 | B2 | 8/2020 | Petrovic et al. | |
| 11,231,255 | B2 * | 1/2022 | Lavin | F41H 13/0025 |
| 2006/0207466 | A1 | 9/2006 | McNulty et al. | |
| 2007/0070573 | A1 | 3/2007 | Nerheim | |
| 2007/0188972 | A1 | 5/2007 | Nerheim | |
| 2007/0283834 | A1 | 12/2007 | Chen | |
| 2010/0050856 | A1 | 3/2010 | Baldwin | |
| 2015/0002981 | A1 | 1/2015 | Klug et al. | |
| 2016/0258718 | A1 | 9/2016 | Chang | |
| 2017/0059661 | A1 | 3/2017 | Foldyna | |
| 2018/0283829 | A1 * | 10/2018 | Petrovic | F41H 13/0025 |
| 2019/0128650 | A1 | 5/2019 | Kim | |
| 2020/0333117 | A1 * | 10/2020 | Petrovic | F41H 13/0025 |

FOREIGN PATENT DOCUMENTS

| | | | |
|---|---|---|---|
| RU | 2669976 | C2 * | 10/2018 |
| RU | 2669976 | C2 | 10/2018 |

OTHER PUBLICATIONS

International Searching Authority, International Preliminary Report on Patentability and Written Opinion of the International Searching Authority for International Patent Application PCT/US2017/043756 dated Oct. 1, 2019.

USPTO, Non-Final Office Action for U.S. Appl. No. 15/657,909, dated Nov. 18, 2019.

USPTO, Notice of Allowance and Fee(s) Due for U.S. Appl. No. 15/657,909, dated Mar. 23, 2020.

USPTO, Corrected Notice of Allowability U.S. Appl. No. 15/657,909, dated Jul. 7, 2020.

USPTO, Notice of Allowance and Fee(s) Due for U.S. Appl. No. 16/917,137, dated Jan. 25, 2022.

* cited by examiner

BARRIER FOR A DEPLOYMENT UNIT OF A CONDUCTED ELECTRICAL WEAPON

CROSS-REFERENCE TO RELATED APPLICATIONS

This application is a continuation of, and claims priority to and the benefit of, U.S. patent application Ser. No. 16/917,137, filed on Jun. 30, 2020, and entitled "OUTER CONDUCTIVE BAND FOR A DEPLOYMENT UNIT OF A CONDUCTED ELECTRICAL WEAPON", which was a continuation of, and claimed priority to and the benefit of, U.S. patent application Ser. No. 15/657,909, filed on Jul. 24, 2017, and entitled "SYSTEMS AND METHODS FOR A DEPLOYMENT UNIT OF A CONDUCTED ELECTRICAL WEAPON", which claimed priority to and the benefit of U.S. Provisional Patent Application No. 62/478,710, filed on Mar. 30, 2017, and entitled "SYSTEMS AND METHODS FOR A DEPLOYMENT UNIT OF A CONDUCTED ELECTRICAL WEAPON", each of which are incorporated by reference in their entirety.

BRIEF DESCRIPTION OF THE SEVERAL VIEWS OF THE DRAWINGS

Embodiments of the present invention will be described with reference to the drawings, wherein like designations denote like elements, and.

Figure 1:
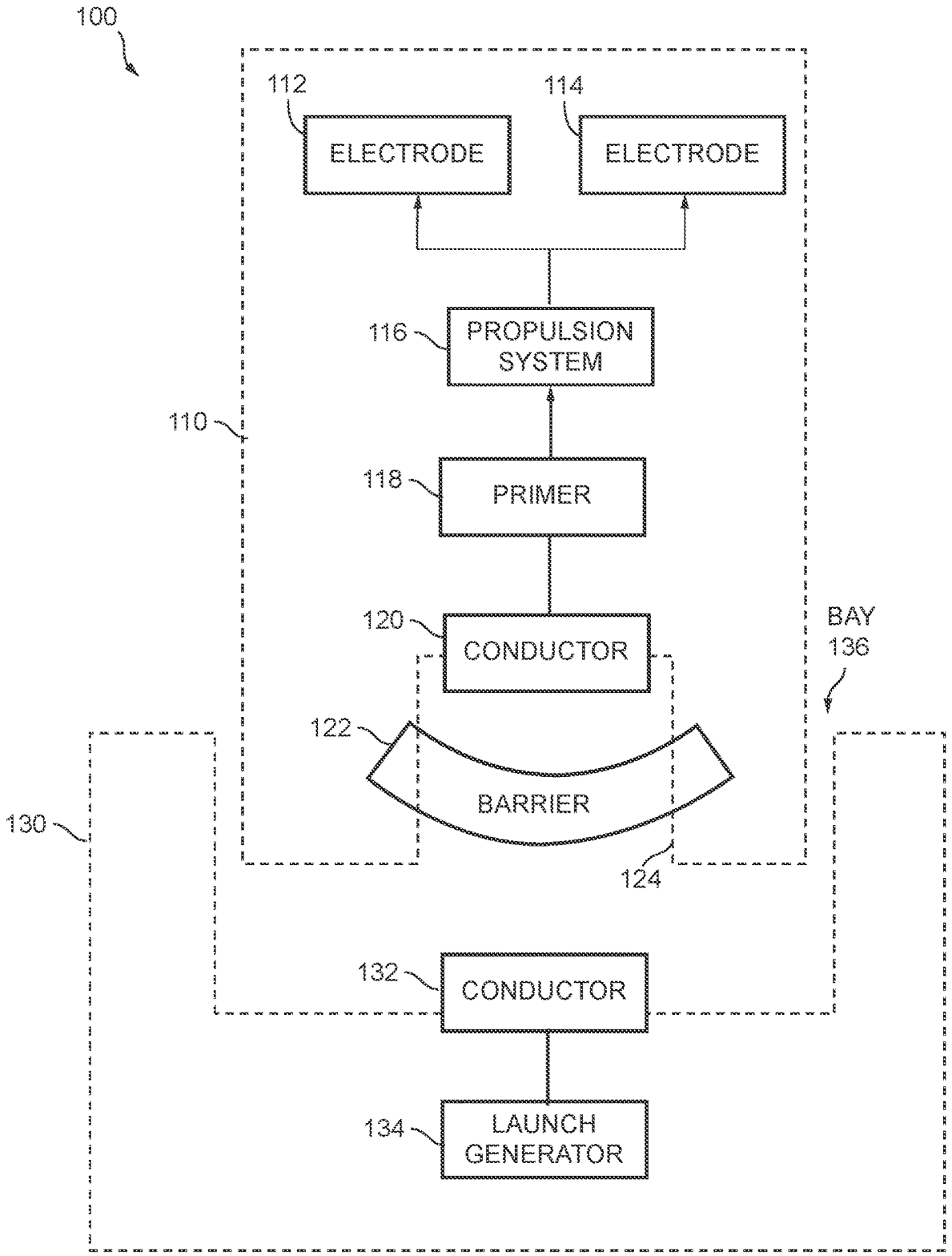
FIG. 1 is a block diagram of a portion of a deployment unit and a portion of a handle that cooperate to perform the functions of a conducted electrical weapon ("CEW") according to various aspects of the present disclosure.
Figure 2:
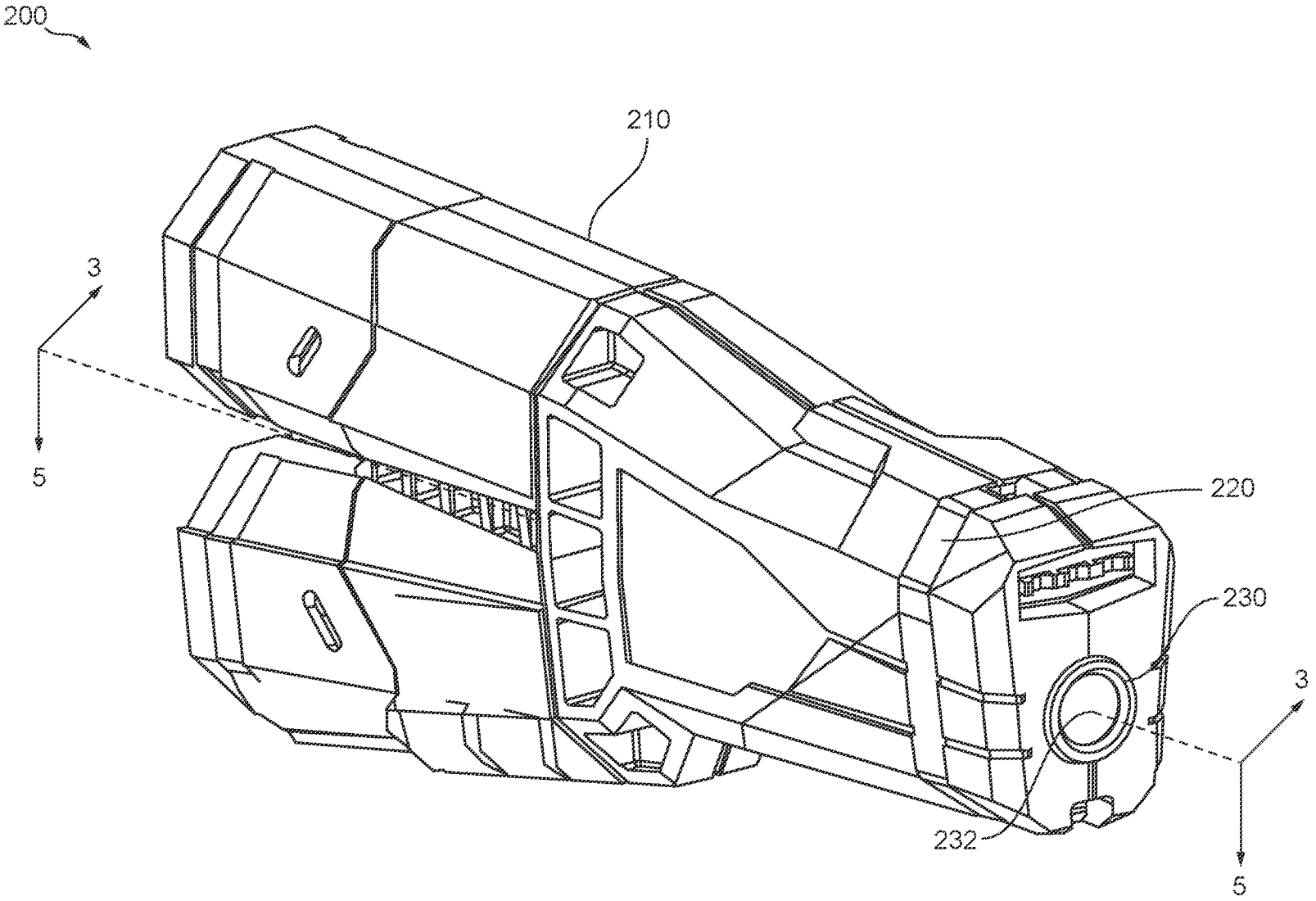
FIG. 2 is drawing of an implementation of the deployment unit of FIG. 1.
Figure 3:
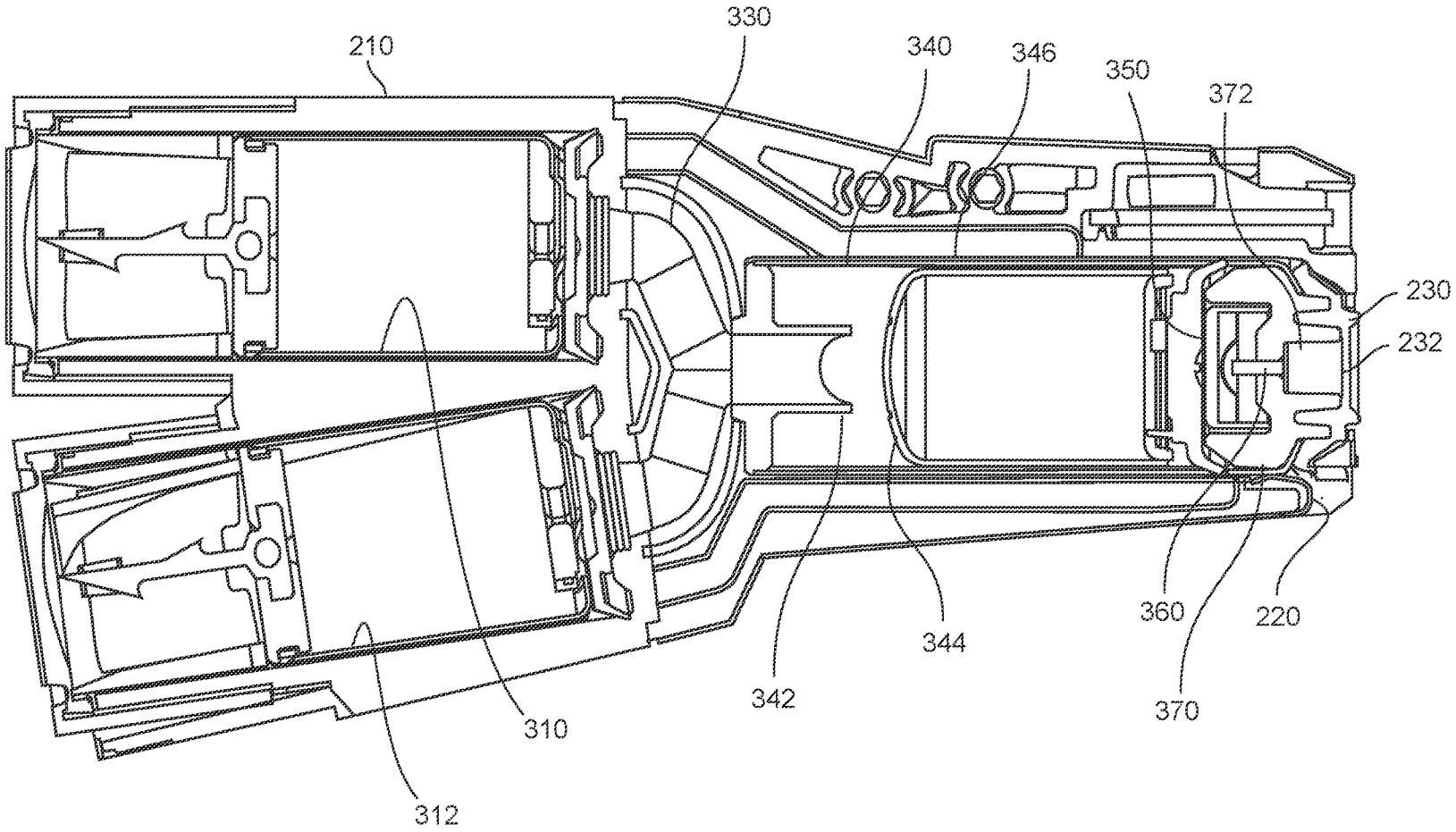
FIG. 3 is drawing of cross section along 3-3 of the deployment unit in FIG. 2.
Figure 4:
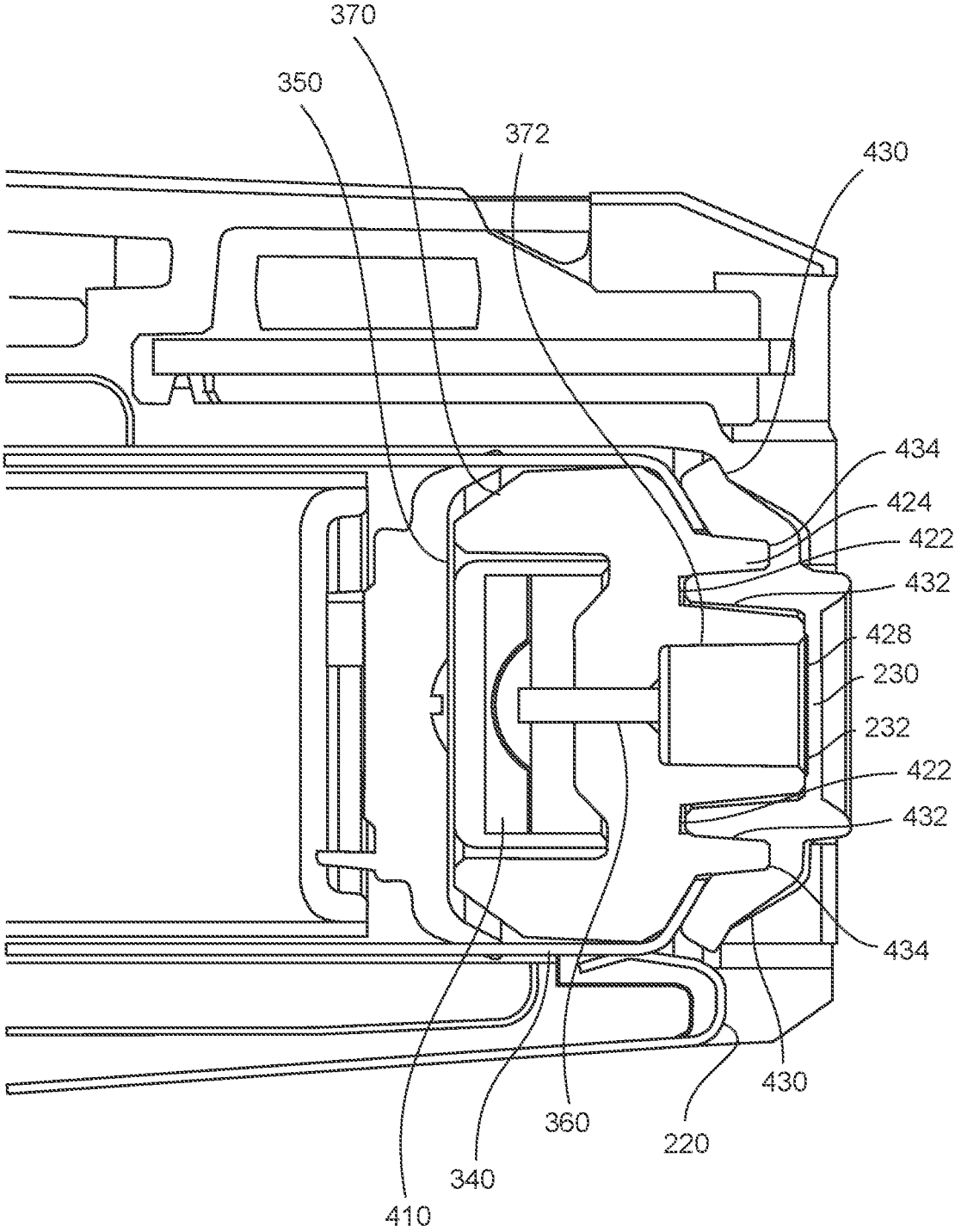
FIG. 4 is close up of the cross section of the deployment unit in FIG. 3.
Figure 5:
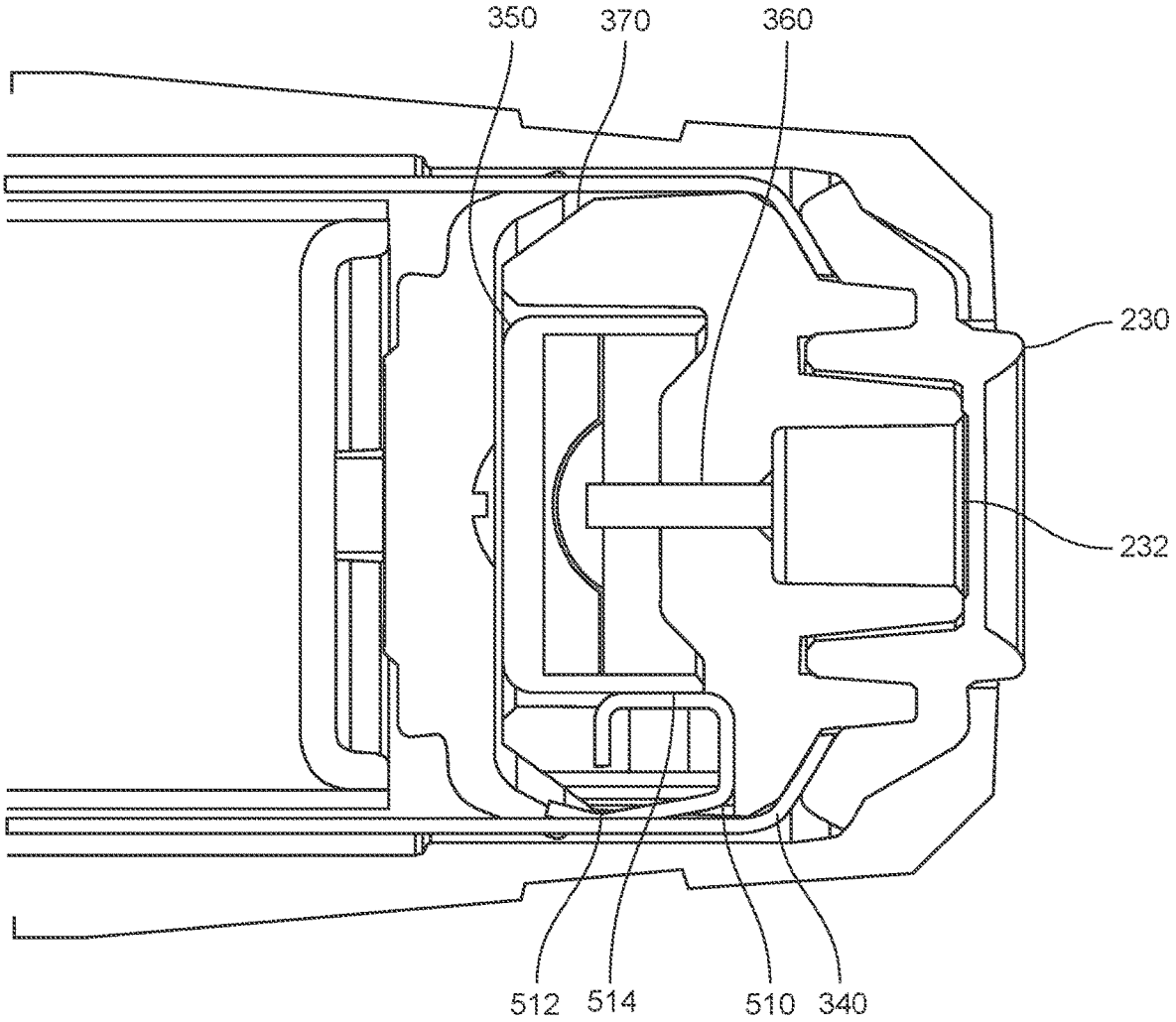
FIG. 5 is close up of cross section 5-5 of the deployment unit in FIG. 2.
Figure 6:
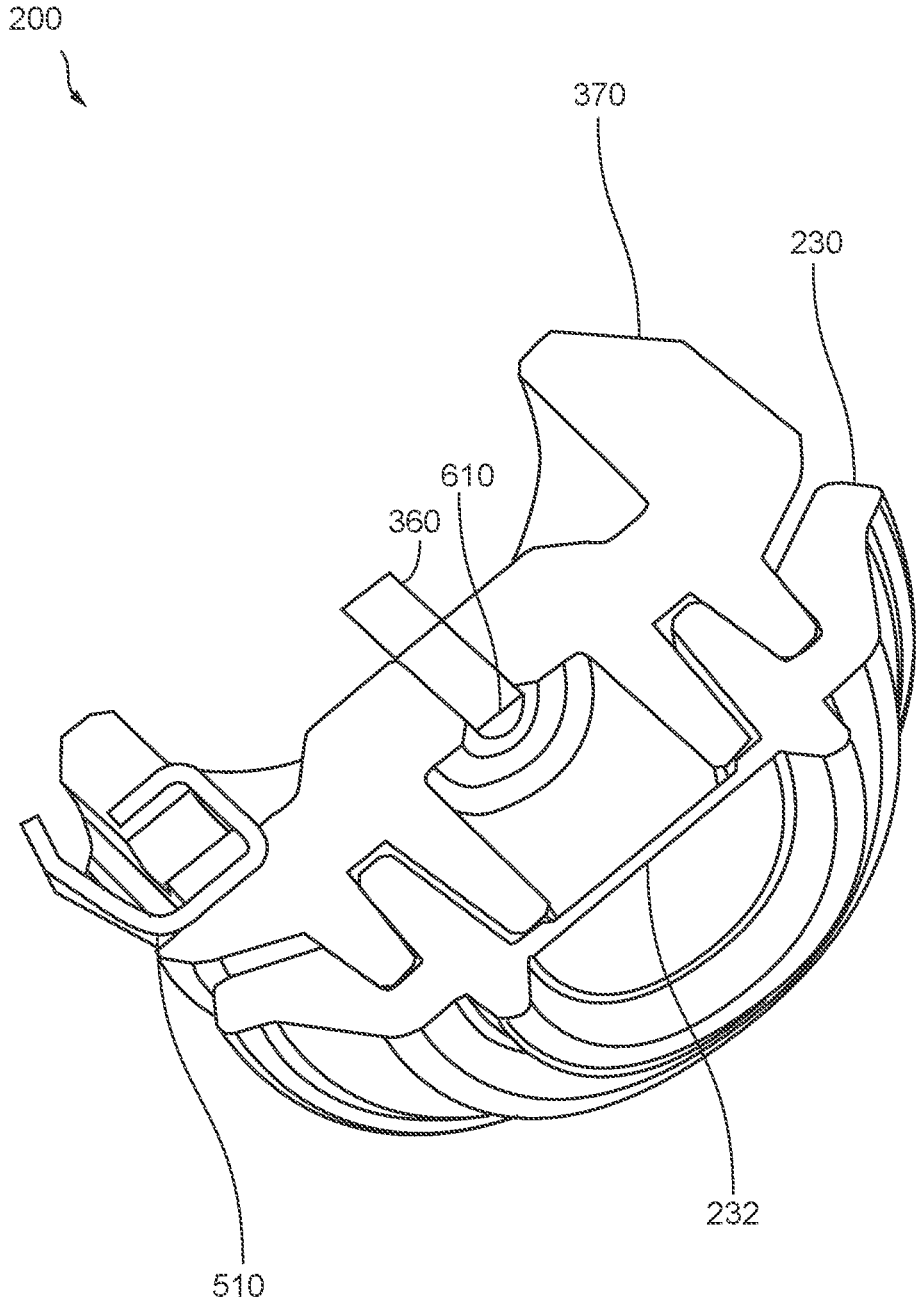
FIG. 6 is the electrode, cup, cap, and spring of FIG. 5 rotated to show an end portion of the cap.
Figure 7:
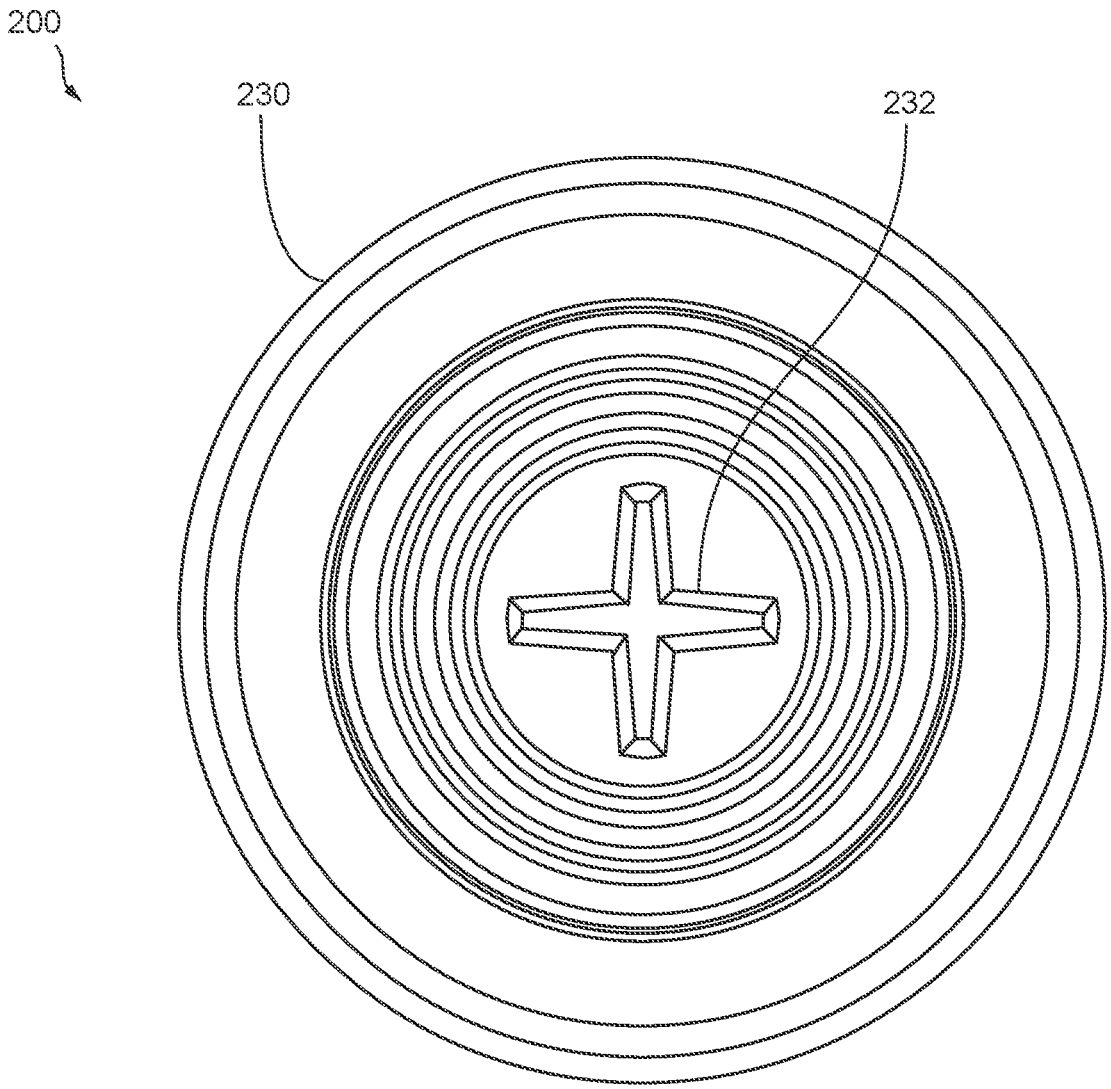
FIG. 7 is an inside view of the cap of FIG. 2.

The numerical indicators of the drawing refer to the following structures: 110—deployment unit (e.g., cartridge); 112—electrode; 114—electrode; 116—propulsion system; 118—primer; 120—conductor; 122—barrier; 130—handle; 132—conductor; 134—launch generator; 136—bay; 200—deployment unit (e.g., cartridge); 210—housing; 220—band; 230—cap; 232—frangible portion; 310—electrode; 312—electrode; 330—manifold; 340—propulsion system; 342—anvil; 344—canister; 346—housing; 350—primer; 360—conductor; 370—cup; 372—cavity; 410—pyrotechnic; 422—groove; 424—protrusion; 428—protrusion; 430—wing; 432—protrusion; 434—groove; 440—location; 510—spring; 512—location; 514—location; 610—end portion; 800—handle; 810—conductor; 820—pin; 830—housing; 840—bay; 910—location; 930—protrusion; 940—compression; 942—compression; 944—compression; and 946—compression.

DETAILED DESCRIPTION OF THE INVENTION

A conducted electrical weapon ("CEW") is a device that provides a stimulus signal to a human or animal target. The stimulus signal may be provided to a target via launched electrodes or terminals that are pressed against the target. A stimulus signal inhibits locomotion of the target. Locomotion may be inhibited by interfering with voluntary use of skeletal muscles and/or causing pain in the target. A stimulus signal that interferes with skeletal muscles may cause the skeletal muscles to lockup (e.g., freeze, tighten, stiffen) so that the target may not voluntarily move.

A CEW may include a handle and one or more deployment units (e.g., cartridges). Deployment units removeably insert into the handle. A deployment unit includes one or more wire-tethered electrodes that are launched by a propellant toward a target to provide the stimulus signal through the target.

The handle of a CEW may include a launch generator circuit. The launch generator may provide a signal to a deployment unit to launch the electrodes of the deployment unit. The signal from the launch generator may be provided at a relatively high (e.g., 500-5,000) voltage. The signal may be provided via a conductor of the handle. The conductor of the handle may be positioned proximate to a conductor of the deployment unit to provide the signal. The conductor of the handle may be separated from the conductor of the deployment unit by a gap of air. The signal may ionize the air in the gap to provide the signal to the deployment unit.

A deployment unit may be inserted (e.g., positioned) in a bay of the handle to position the conductor of the handle proximate to the conductor of the deployment unit. A deployment unit may be held (e.g., fixed) in the bay of the handle before, during and after launch of the one or more electrodes. A deployment unit whose electrodes have been launched (e.g., expended, fired, used) may be removed from the bay and replaced with a new (e.g., unused, unfired) deployment unit. A handle may have one or more bays for accepting deployment units.

Prior to inserting a deployment unit into a handle, the deployment unit may be stored and/or transported. During storage and/or transport, a deployment unit may be affected by Electrostatic discharge (ESD). Electrostatic discharge (ESD) is the sudden flow of electricity between two electrically charged objects caused by contact or by near contact via ionization. The ESD occurs when differently-charged objects are brought close together often creating a visible spark. ESD may occur when the finger of an individual handling a deployment unit is brought in close proximity with the conductor of the deployment unit. ESD may damage (e.g., destroy, affect) the deployment unit. ESD may cause the electrodes of the deployment unit to launch. ESD may damage electronic circuitry in the deployment unit.

A barrier (e.g., cover, insulator, shield) may be used to protect a deployment unit from ESD. A barrier may reduce a potential effect that ESD may have on a deployment unit. A barrier may further protect a deployment unit from dirt and moisture prior to use. A barrier may improve the reliable firing (e.g., operation) of the deployment unit once inserted into a handle.

For example, CEW 100 includes deployment unit 110 and handle 130. Handle 130 includes conductor 132, launch generator 134, and bay 136. Deployment unit 110 includes electrode 112, electrode 114, propulsion system 116, primer 118, conductor 120, and barrier 122. Deployment unit 110 removeably inserts into bay 136.

Deployment unit 110, handle 130, and bay 136 perform the functions of a deployment unit, a handle, and a bay respectively as discussed above.

A bay includes a receptacle (e.g., chamber, holder, container, female fitting) positioned in a handle of a CEW. A bay accepts (e.g., receives, takes, holds) a deployment unit (e.g., cartridge). A deployment unit may be removeably inserted (e.g., positioned, placed, attached) in a bay. A handle may include one or more bays that each receive a respective deployment unit. A deployment unit may include a housing, a filament (e.g., wire, tether), one or more electrodes, and a pyrotechnic (e.g., propulsion). A pyrotechnic, responsive to initiation (e.g., firing), may provide a rapidly expanding gas for launching the electrodes toward a target to deliver a current through a target. A filament couples to the handle and to at least one electrode. The filament provides the current from the handle to the electrode and through the target.

For example, in FIG. 1, deployment unit 110 may be removeably inserted into bay 136. A shape of the housing of deployment unit 110 may align with interior surfaces of bay 136 of handle 130. The shape of the housing and the interior surfaces of bay 136 may guide the movement of deployment unit 110 during insertion into bay 136 of handle 130. Once inserted, deployment unit 110 may be held in bay 136 by friction, interference of one surface with another surface, and/or a latch. Deployment unit 110 may be removed from bay 136. Removal may require a reduction in friction, removal of an interfering surface, and/or operation of a latch to permit deployment unit 110 to be extracted (e.g., pulled) from bay 136. Once deployment unit 110 is removed from bay 136 a new or different deployment unit 110 may be inserted in to bay 136.

A launch generator is a circuit that provides a launch signal. A launch signal is an electrical signal that may be used to initiate the launch of electrodes from a deployment unit. A processing circuit in the handle may control the launch generator in whole or in part. A processing circuit may instruct the launch circuit to provide a launch signal responsive to input (e.g., trigger pull) provided by the operator of the handle. A launch generator may provide a launch signal to a deployment unit via a conductor.

A conductor is a material or object that permits through which an electric current or signal may flow. A conductor provides a path for propagation of an electric current or signal. A conductor may provide a desired (e.g., intended) path for flow of a current or signal. A conductor may provide a path for a launch generator to send a launch signal to a deployment unit.

For example, launch generator 134 of FIG. 1 is coupled to conductor 132. Deployment unit 110 may be removeably inserted into bay 136. Once inserted, conductor 132 is positioned proximate to conductor 120. A gap of air may exist between conductor 132 and conductor 120. Conductor 120 may be positioned proximate to or electrically coupled to primer 118.

Launch generator 134 provides a launch signal to conductor 132. The launch signal flows through conductor 132, ionizes the air in the gap between conductor 132 and conductor 120 to establish a circuit through primer 118 via conductor 120.

A barrier may block access. A barrier may shield one object from another object. A barrier may protect. A barrier may block an opening in a deployment unit. Blocking an opening of a deployment unit stops ingress of objects and/or a force (e.g., electrical current) into the deployment unit. Blocking an opening of a deployment unit stops egress of objects and/or a force out of the deployment unit. A barrier may shield internal portions of a deployment unit from the surrounding environmental conditions. Environmental conditions may include ESD, moisture, and dirt. A barrier may insulate a conductor.

A barrier may be formed of a non-conductive material. A non-conductive material reduces transfer of electrical charge from an exterior of a deployment unit into the deployment unit. A non-conductive material prohibits a flow of current through the material. A non-conductive material positioned around a conductor insulates the conductor.

A barrier may have a frangible surface to allow (e.g., facilitate) piercing of the barrier by an object. A barrier may be pierced during insertion of a deployment unit into a handle. A conductor may pierce a barrier. Piercing a barrier permits a conductor of a handle to be positioned proximate to a conductor of a deployment unit.

For example, barrier 122 blocks access to the internal portions of deployment unit 110 via opening 124. Barrier 122 shields the interior portions of deployment unit 110 from the environment. Barrier 122 shields conductor 120 from ESD and debris. Without barrier 122, ESD from the environment (e.g., a user's finger, another object) may propagate from the environment to conductor 120 and to primer 118. ESD through opening 124 to conductor 120 may ignite primer 118 and launch electrodes 112 and 114. Barrier 122 insulates conductor 120 from ESD.

Barrier 122 may mechanically seal opening 124 around conductor 120. The mechanical seal between barrier 122 and the housing of deployment unit 110 protects conductor 120 from moisture and dirt. Moisture and dirt may degrade and/or interfere with the electrical operation of conductor 120. Moisture and dirt may redirect a flow of electrical current away from conductor 120 so that the current flows along an unintended path as opposed to through conductor 120. A barrier may couple to a housing of deployment unit 110. Coupling a barrier to a housing of a deployment unit may prevent or reduce a flow of current between the barrier and a surface of the housing into an interior of the housing. A barrier may be formed of a compressible, non-conductive material. A barrier may be compressed against a housing of a deployment unit to prevent or reduce an unintended flow of current between the barrier and the housing into an interior of a deployment unit. A barrier may be compressed around a surface of an opening in a deployment unit to prevent an unintended flow of current from an exterior of the deployment unit into an interior of the deployment unit and/or an unintended flow of current from an interior of the deployment unit to an exterior of the deployment unit.

A barrier may insulate a conductor to increase a likelihood that a flow of current through the conductor remains in the conductor rather than exiting the conductor to flow through paths proximate to the conductor. Insulating a conductor with the barrier increases the likelihood that a current will flow through the intended path of the conductor rather than through an unintended path other than the conductor.

Deployment unit 110 may be removeably inserted into bay 136. Inserting deployment unit 110 into bay 136 moves conductor 132 toward conductor 120. As conductor 132 moves toward conductor 120, conductor 132 pierces barrier 122 and continues to move toward conductor 120 until conductor 132 is proximate to conductor 120. Once conductor 132 has pierced barrier 122 and is positioned proximate to conductor 120, barrier 122 contacts a portion of conductor 132 thereby providing at least a partial barrier (e.g., a partial seal) to protect the interior of deployment unit 110 from environmental conductions. Further the sealing contact of barrier 122 around conductor 132 helps to prevent or reduce the flow of a current from conductor 132 along unintended paths on an exterior of deployment unit 110.

Barrier 122 may form a shield around conductor 120 and the portion of conductor 132 that pierced barrier 122 and is positioned proximate to conductor 120. Shielding the volume around conductor 120 and conductor 132 with barrier 122 increases a likelihood that a current provided to conductor 132 by launch generator 134 will flow from conductor 132 to and through conductor 120. In an implementation, conductor 132 is positioned proximate to, but does not touch, conductor 120. A current that flows through conductor 132 must ionize air in a gap between conductor 132 and conductor 120 to permit the current to flow through conductor 120. Insulating the area around conductor 132 and conductor 120 increases the likelihood that the current from conductor 132 will arc to conductor 120 and not along unintended path to some other interior portion of deployment unit 110.

A barrier may include a frangible portion to facilitate and/or control breaking when the barrier is pierced.

A primer includes a pyrotechnic. The pyrotechnic of a primer may be ignited responsive to percussion (e.g., a percussive force, impact) or electricity. Ignition of the pyrotechnic produces a rapidly expanding gas. A force of the rapidly expanding gas may be directly or indirectly to launch one or more projectiles such as electrodes (e.g., darts). A force of the rapidly expanding gas may be used to pierce a canister to release another rapidly expanding gas to launch the one or more electrodes.

For example, as discussed above launch generator 134 provides a launch signal through primer 118 via conductors 132 and 120. The launch signal activates the pyrotechnic in primer 118 to ignite the pyrotechnic. Primer 118 provides a rapidly expanding gas to propulsion system 116 to launch electrodes 112 and 114 toward a target.

A propulsion system provides a force (e.g., a rapidly expanding gas) to launch electrodes toward a target. Electrodes land (e.g., impact) in or near target tissue to deliver a stimulus signal through a target to impede locomotion of the target. A propulsion system may include a canister that is filled with a compressed gas. Piercing (e.g., puncturing, opening) the canister releases the gas. The rapid expansion of the gas from the canister provides a force to launch electrodes.

One or more electrode may be launched toward a target to establish an electrical circuit through a target. A stimulus signal may be provided via the circuit to the target. The stimulus signal may interfere with target locomotion. An electrode may be tethered to a high voltage circuit in the handle. Launching an electrode deploys the tether, so that it bridges the distance between the CEW and the target. The stimulus signal is delivered through the target via tether and electrode electrically coupled to the tether.

For example, activation of propulsion system 116 launches electrodes 112 and 114 toward a target. Propulsion system 116 provides an expanding gas to push electrodes 112 and 114 out of tubes (e.g., bores) in handle 130 toward a target. As electrodes 112 and 114 fly toward the target, a conductive filament (not shown) extends between handle 130 and electrodes 112 and 114. The filament electrically couple electrodes 112 and 114 to a signal generator (not shown) that provides the stimulus signal. While electrodes 112 and 114 are proximate to target tissue, the stimulus signal forms a circuit to deliver the stimulus signal through the target. The circuit includes a first wire tether (not shown), electrode 112, target tissue, electrode 114, and a second wire tether (not shown). The stimulus generator (not shown) electrically couples to the first wire tether and the second wire tether to provide the stimulus signal through the circuit.

Deployment unit 200 of FIGS. 2-9 is an implementation of deployment unit 110. Deployment unit 200 in FIGS. 2-9 performs the functions of a deployment unit as discussed above.

Deployment unit 200 includes housing 210, band 220, and cap 230, electrode 310, electrode 312, manifold 330, propulsion system 340, primer 350, conductor 360, cup 370, and end portion 610.

Cap 230 includes frangible portion 232, wing 430, protrusion 432, and groove 434.

Cup 370 includes groove 422, protrusion 424, protrusion 428, and cavity 372.

Propulsion system 340 includes housing 346, anvil 342, canister 344, and spring 510.

Primer 350 includes pyrotechnic 410.

Cap 230 performs the functions of a barrier including barrier 122 as discussed above. Electrodes 310 and 312, propulsion system 340, primer 350, and conductor 360 perform the functions of an electrode including electrodes 112 and 114, a propulsion system including propulsion system 116, a primer including primer 118, and a conductor including conductor 120 respectively as discussed above.

Figure 8:
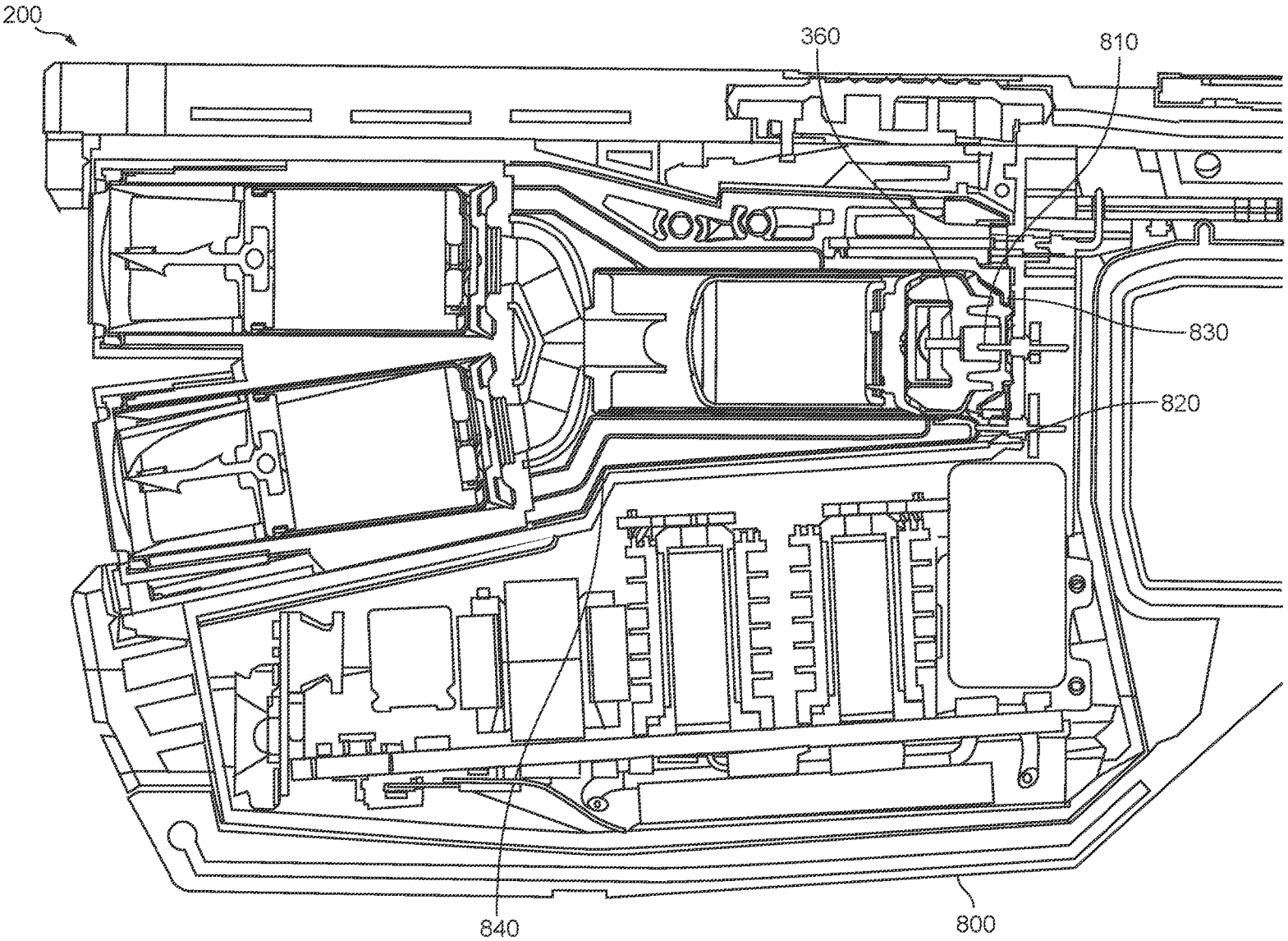
FIG. 8 is drawing showing a portion of the cross section of the deployment unit of FIG. 3 while inserted into a portion of an implementation of a handle of FIG. 1.
Figure 9:
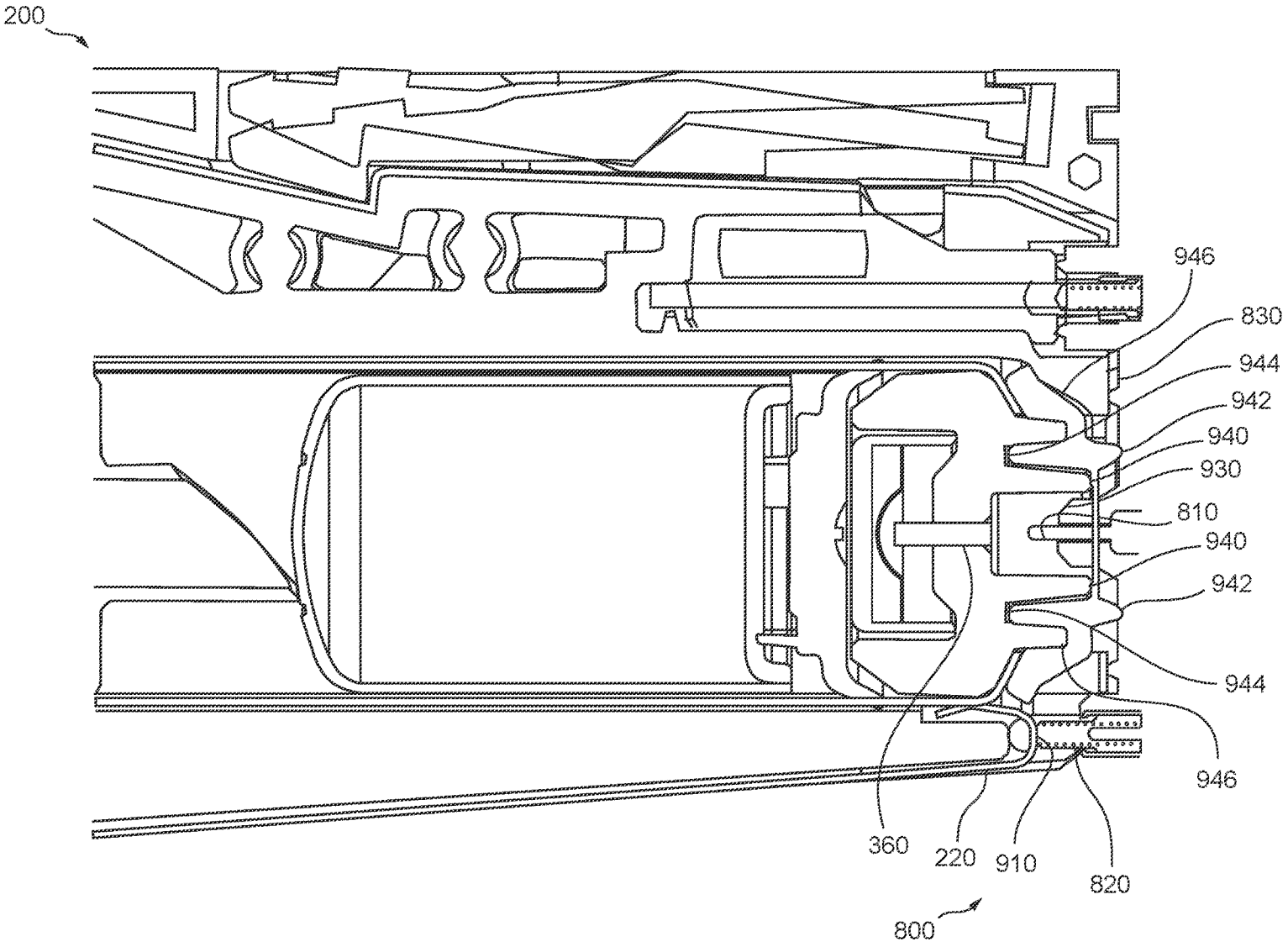
FIG. 9 is close up of the cross section of the deployment unit and handle in FIG. 9.

Handle 800 in FIGS. 8-9 is an implementation of handle 130. Handle 800 in FIGS. 8-9 performs the functions of a handle as discussed above. Handle 800 in FIGS. 8-9 includes conductor 810, pin 820, housing 830, protrusion 930, compression 940, compression 942, compression 944, and compression 946.

Conductor 810 perform the functions of a conductor including conductor 132 as discussed above.

Deployment unit 200 removeably inserts into a bay of a handle. For example, in FIG. 8, deployment unit 200 may be removeably inserted into the bay 840 of handle 800. A shape of housing 210 of deployment unit 200 may align with interior surfaces of the bay 840. The shape of the housing 210 and the interior surfaces of the bay 840 may guide the movement of deployment unit 200 during insertion into the bay 840. Once inserted, deployment unit 200 may be held in the bay 840 by friction and/or interference of one surface with another surface, and/or a latch. Deployment unit 200 may be removed from the bay 840. Removal may require a force to overcome friction, moving an interfering surface, and/or operation of a latch to permit deployment unit 200 to be extracted (e.g., pulled) from the bay 840. Once deployment unit 200 is removed from the bay 840 a new or different deployment unit 200 may be inserted into the bay 840. A handle may include one or more bays 840.

Band 220 is formed of metal. Metal is highly conductive of electricity. Once deployment unit 200 is inserted into the bay 840, pin 820 of handle 800 contacts band 220 of deployment unit 200 at location 910. Pin 820 provides electrical connectivity to band 220. Pin 820 may cooperate to form an electrical circuit between handle 800 and deployment unit 200. In an implementation, pin 820 provides a ground voltage (e.g., zero volts) used as a voltage reference for electrical signals and electrical power from handle 800 to deployment unit 200.

Propulsion system 340 includes housing 346 formed of metal. Band 220 electrically couples to housing 346. Pin 820 electrically couples to band 220. Pin 820 establishes the voltage potential of housing 346. Spring 510, inside housing 346, contacts the inner surface of housing 346 at location 512. Spring 510 contacts an outer, metallic surface of primer 350 at location 514. Pin 820 establishes the voltage potential of primer 350 via housing 346 and spring 512. Spring 512 may further apply a force to primer 350 to retain primer 350. In an implementation, spring 510, the surface of primer 350, housing 346, band 220 and pin 820 are all metallic and electrically couple to provide a ground reference voltage for deployment unit 200.

A barrier may perform the functions of protecting a deployment unit from dirt, moisture and debris. A barrier may perform the function of protecting a deployment unit from electrostatic discharge ("ESD"). A barrier may perform the function of directing a launch current provided by a handle. A barrier may fit into a portion of a deployment unit to perform the functions of a barrier. A barrier may cover, prior to use, an opening of a deployment unit to protect the deployment unit.

For example, cap 230 of deployment unit 200 performs the functions of a barrier including barrier 122 as discussed above. Cap 230 cooperates with cup 370 to form a barrier. Prior to inserting deployment unit 200 into handle 800, cap 230 covers the opening of cavity 372. Covering cavity 372 protects the interior of deployment unit 200 from dirt, moisture, and debris.

Covering cavity 372 further protects deployment unit 200 from ESD. Cap 230 also shields conductor 360 from ESD. The material of cap 230 that covers cavity 372 creates a high impedance path between conductor 360 and the environment. Absent cap 230, an ESD current could discharge from the object (e.g., user's finger) outside of deployment unit 200 into conductor 360. An ESD current from the environment into conductor 360 might possibly travel through pyrotechnic 410 of primer 350. A sufficiently large ESD current through pyrotechnic 410 could ignite pyrotechnic 410 and thereby launch electrodes 310 and 312 of deployment unit 200. Lacking cap 230, an inadvertent launch of electrodes 310 and 312 due to an ESD current could occur while a user handles deployment unit 200. Cap 230 and cup 370 reduce the likelihood that an ESD current will activate deployment unit 200 during storage, handling, and/or transport.

Cap 230 and cup 370 also cooperate to direct (e.g., steer) a launch current provided by handle 800 while deployment unit 200 is inserted into handle 800. Steering the launch current from handle 800 increases the reliable performance of a CEW. A surface of cap 230 includes frangible portion 232 that is pierced (e.g., torn, split) by conductor 810 when deployment unit 200 is inserted into handle 800. Prior to using deployment unit 200, frangible portion 232 is intact and covers cavity 372 as discussed above. When deployment unit 200 is inserted into handle 800, conductor 810 contacts and breaks frangible portion 232. As deployment unit is further inserted into handle 800, conductor 810 moves into cavity 372. When deployment unit 200 is fully inserted into handle 800, conductor 810 is positioned proximate to conductor 360.

In another implementation, cap 230 includes one or more flaps that overlap to cover cavity 372 to protect the interior of deployment unit 200 and in particular conductor 360 from ESD current. When deployment unit 200 is inserted into handle 800, conductor 810 pushes the one or more flaps out if its way so that conductor 810 moves into cavity 372 proximate to conductor 360. While conductor 810 is positioned in cavity 372, the flaps may contact conductor 810 to enclose conductor 810.

When deployment unit 200 is fully inserted into handle 800, the ridge around frangible portion 232 presses against an inner surface of handle 800 to create a seal between an interior of cavity 372 and handle 800. Cap 230 and cup 370 are pressed against each other and pressed against interior surfaces of deployment unit 200 to increase the impedance of any electrical path between cavity 372 and deployment unit 200 and/or handle 800.

Protrusion 428 of cup 370 presses (e.g., seals) tightly into protrusion 432 of cap 230 and protrusion 432 of cap 230 presses into groove 422 of cup 370. Pressing a protrusion into a groove reduces a likelihood that a high voltage current may travel between cap 230 and cup 307 into an interior of deployment unit 200 and/or handle 800. Wing 430 of cap 230 is positioned over an outer surface of housing 346 and inside an inner surface of housing 210. Wing 430 may be compressed between an outer surface of housing 346 and an inner surface of housing 210 to reduce a likelihood that a high voltage current may travel from cavity 372 to an interior of deployment unit 200 and/or handle 800.

While deployment unit 200 is inserted into handle 800, cap 230 and cup 370 cooperate with the surfaces of each other and the surfaces of deployment unit 200 and handle 800 to seal (e.g., enclose) conductor 810 and conductor 360 in cavity 372. Handle 800 provides a launch current to launch electrodes 310 and 312 to conductor 360 via conductor 810. The voltage of the launch current must be high enough to ionize air in a gap between conductor 360 and conductor 810. The seal between cap 230 and cup 370 and between cap 230 and cup 370 and the interior surfaces of deployment unit 200 and handle 800 increases the impedance of any path exiting cavity 372 so that the launch current will most likely flow from conductor 810, across an ionized gap of air, and into conductor 360 rather than to the interior of deployment unit 200 or handle 800 via any other path. Sealing cavity 372 contains the flow of the launch current so that it travels from conductor 810 to conductor 360 and likely not along any other path that leads outside of cavity 372. The operation of cap 230 and cup 370 to increase the likelihood of the flow of a launch current from conductor 810 to conductor 360 increases the reliable operation of a CEW.

The grooves, protrusions, and wings of cup 370 and cap 230 also increase the surface area of a mechanical seal between cap 230, cup 370, and housing 210 to better protect the interior portions of deployment unit 200 from dirt, moisture, and debris before deployment unit 200 is inserted into handle 800.

During insertion of deployment unit 200 into the bay 840, a portion of conductor 810 breaks frangible portion 232 of cap 230. Once deployment unit 200 is fully inserted into bay 840 a portion of conductor 810 is inside cavity 372 and is positioned proximate to conductor 360.

End portion 610 of conductor 360 is positioned inside cavity 372. End portion 610 of conductor 360 is positioned proximate to conductor 810 once deployment unit 200 is fully inserted into bay 840. The other end portion of conductor 360 extends from cup 370 toward primer 350 and is positioned proximate to, possibly embedded in, pyrotechnic 410 of primer 350.

Primer 350 is formed of metal. Primer 350 includes a cavity. Pyrotechnic 410 is positioned in the cavity of primer 350. Primer 350 includes an opening to the cavity. An end portion of conductor 360 is positioned in the opening so that, as discussed above, conductor 360 is positioned proximate to or in pyrotechnic 410.

Pyrotechnic 410 of a primer 350 may be ignited responsive to percussion or electricity. Ignition of the pyrotechnic produces a rapidly expanding gas.

Handle 800 includes a launch generator (not shown). The launch generator circuit performs the functions of a launch generator including launch generator 134 as discussed above. The launch generator of handle 800 provides a launch current to deployment unit 200 via conductor 810. The voltage of the launch current may be high enough to ionize air in a gap between conductor 810 and conductor 360 so that the launch current flows from the launch generator to conductor 360 via conductor 810. Conductor 360 provides the launch current to pyrotechnic 410 of primer 350. The launch current flows through pyrotechnic 410 to the metallic surface of primer 350. Primer 350 electrically couples to launch generator thereby providing a circuit for the flow of a launch current from the launch generator through pyrotechnic 410.

In an implementation, the launch current forms a circuit through pyrotechnic 410. The circuit includes conductor 810, a gap of air between conductor 810 and conductor 360 that is ionized by the launch current, conductor 360, pyrotechnic 410, metallic outer surface of primer 350, spring 510, housing 346, band 220 and pin 820. The launch generator electrically couples to the conductor 810 and pin 820 to provide the launch current through the circuit. The launch current ignites pyrotechnic 410.

Propulsion system 340 contains canister 344. Canister 344 contains a compressed gas. Propulsion system 340 also contains anvil 342. Anvil 342 is positioned proximate to canister 344. Igniting pyrotechnic 410 causes pyrotechnic 410 to produce an expanding gas. The force of the expanding gas presses against canister 344 and moves canister 344 against anvil 342. The force of the expanding gas from pyrotechnic 410 is sufficient to cause anvil 342 to pierce (e.g., puncturing, opening) canister 344. Piercing canister 344 releases the compressed gas from canister 344. The compressed gas exits anvil 342 via the hollow tube inside anvil 342 to rapidly expand into manifold 330 to apply a force on electrodes 310 and 312 that launches electrodes 310 and 312 from deployment unit 200.

As electrodes 310 and 312 fly toward the target, electrodes 310 and 312 deploy a respective filament (not shown) so that electrodes 310 and 312 remain electrically coupled to a signal generator (not shown) of handle 800. The signal generator provides a stimulus signal to the target via the filaments and electrodes 310 and 312. In an implementation, a circuit through a target for providing the stimulus signal includes a first wire tether (not shown), electrode 310, target tissue, electrode 312, and a second wire tether (not shown). The stimulus generator electrically couples to the first wire tether and the second wire tether to provide the stimulus signal through the circuit.

The foregoing description discusses embodiments, which may be changed or modified without departing from the scope of the invention as defined in the claims. Examples listed in parentheses may be used in the alternative or in any practical combination. As used in the specification and claims, the words 'comprising', 'comprises', 'including', 'includes', 'having', and 'has' introduce an open-ended statement of component structures and/or functions. In the specification and claims, the words 'a' and 'an' are used as indefinite articles meaning 'one or more'. When a descriptive phrase includes a series of nouns and/or adjectives, each successive word is intended to modify the entire combination of words preceding it. For example, a black dog house is intended to mean a house for a black dog. While for the sake of clarity of description, several specific embodiments of the invention have been described, the scope of the invention is intended to be measured by the claims as set forth below. In the claims, the term "provided" is used to definitively identify an object that not a claimed element of the invention but an object that performs the function of a workpiece that cooperates with the claimed invention. For example, in the claim "an apparatus for aiming a provided barrel, the apparatus comprising: a housing, the barrel positioned in the housing", the barrel is not a claimed element of the apparatus, but an object that cooperates with the "housing" of the "apparatus" by being positioned in the "housing". The invention includes any practical combination of the structures and methods disclosed. While for the sake of clarity of description several specifics embodiments of the invention have been described, the scope of the invention is intended to be measured by the claims as set forth below.

The location indicators "herein", "hereunder", "above", "below", or other word that refer to a location, whether specific or general, in the specification shall be construed to refer to any location in the specification where the location is before or after the location indicator.

What is claimed is:

1. A deployment unit for a conducted electrical weapon ("CEW") comprising:
- a housing having a first end opposite a second end, wherein the second end defines an opening;
- an electrode configured to be deployed from the first end of the housing;
- a propulsion system positioned in the housing and configured to deploy the electrode;
- a conductor positioned in the housing proximate the propulsion system; and
- a barrier at least partially positioned in the opening of the housing between the conductor and the second end of the housing, wherein the barrier is compressed against an inner surface of the opening to at least partially protect the conductor from moisture, dirt, or debris.

2. The deployment unit of claim 1, wherein the barrier comprises a non-conductive material configured to at least partially reduce a flow of electrical current from an exterior of the housing to an interior of the housing.

3. The deployment unit of claim 1, wherein the barrier comprises a frangible portion positioned axially outward from the conductor.

4. The deployment unit of claim 1, wherein the barrier comprises a plurality of overlapping flaps.

5. The deployment unit of claim 1, wherein the barrier is at least one of axially compressed and radially compressed against the inner surface of the opening.

6. A conducted electrical weapon ("CEW") comprising:
- a handle comprising:
  - a bay;
  - a handle conductor at least partially exposed within the bay; and
  - a launch generator electrically coupled to the handle conductor, wherein the launch generator is configured to provide a launch current to the handle conductor; and
- a deployment unit removably insertable within the bay of the handle, the deployment unit comprising:
  - a housing having a first end opposite a second end, wherein the second end defines an opening;
  - a deployment unit conductor positioned in the housing; and
  - a barrier at least partially positioned in the opening of the housing between the deployment unit conductor and the second end of the housing, wherein the barrier is compressed against an inner surface of the opening to at least partially seal the opening, wherein in response to the deployment unit being inserted into the bay of the handle the handle conductor is configured to pass into the opening and through the barrier, and wherein in response to the launch generator providing the launch current to the handle conductor, the handle conductor is configured to electrically couple to the deployment unit conductor.

7. The CEW of claim 6, wherein the deployment unit further comprises:

an electrode configured to be deployed from the first end of the housing; and a pyrotechnic positioned in the housing proximate the deployment unit conductor, wherein in response to the handle conductor electrically coupling to the deployment unit conductor, the deployment unit conductor is configured to cause the pyrotechnic to ignite to launch the electrode.

8. The CEW of claim 6, wherein the barrier comprises:

a cup defining a cavity, wherein the deployment unit conductor is positioned in the cavity; and a cap configured to cover the cavity of the cup prior to insertion of the deployment unit into the handle.

9. The CEW of claim 8, wherein the cap comprises an outer ridge extending axially outward from the second end of the housing of the deployment unit, and wherein the outer ridge is configured to radially abut a circumferential edge of the opening of the housing.

10. The CEW of claim 9, wherein in response to the deployment unit being inserted into the bay of the handle, the outer ridge of the cap is configured to compress against an interior surface of the bay.

11. The CEW of claim 10, wherein the outer ridge of the cap is configured to compress against an interior surface of the bay to create a seal between an interior of the cavity and the handle.

12. The CEW of claim 8, wherein in response to the deployment unit being inserted into the bay of the handle the handle conductor is positioned in the cavity.

13. The CEW of claim 6, wherein the handle further comprises a pin at least partially exposed within the bay, wherein the pin is configured to provide a ground voltage used as a voltage reference for the launch current from the launch generator of the handle to the deployment unit.

14. The CEW of claim 13, wherein the deployment unit further comprises a conductive band coupled to an outer surface of the housing, wherein in response to the deployment unit being inserted into the bay of the housing, the pin of the handle is configured to electrically couple to the conductive band.

15. The CEW of claim 14, wherein the conductive band is coupled to the outer surface of the housing between the first end and the second end of the housing.

16. A deployment unit for a conducted electrical weapon ("CEW") comprising:

a housing having a first end opposite a second end, wherein the second end defines an opening;

an electrode configured to be deployed from the first end of the housing;

a conductor positioned in the housing proximate the second end of the housing; and a cap positioned in the opening of the housing, wherein the cap is configured to surround and axially separate the conductor from an aft edge of the second end, and wherein the cap is compressed against an inner surface of the opening to at least partially shield the conductor from electrostatic discharge.

17. The deployment unit of claim 16, wherein the cap comprises an outer ridge extending axially outward from the second end of the housing, and wherein the outer ridge is configured to radially abut a circumferential edge of the opening of the housing.

18. The deployment unit of claim 17, wherein the outer ridge of the cap circumferentially encompasses a frangible surface of the cap.

19. The deployment unit of claim 17, wherein the outer ridge of the cap circumferentially encompasses a surface area of the cap, and wherein the surface area of the cap comprises one or more flaps.

20. The deployment unit of claim 16, wherein the cap comprises a wing extending radially from the cap and configured to compress against the inner surface of the opening.

21. The deployment unit of claim 16, further comprising a propulsion system positioned in the housing and configured to deploy the electrode, wherein the propulsion system comprises:

a propulsion system housing; and a primer disposed within the propulsion system housing, wherein the primer is configured to electrically couple to the conductor, and wherein in response to receiving an electrical signal from the conductor the primer is configured to activate to launch the electrode.

22. The deployment unit of claim 21, wherein the cap comprises a wing extending radially from the cap within the housing, wherein the wing is configured to compress against an interior surface of the housing and an exterior surface of the propulsion system housing.

23. The deployment unit of claim 21, further comprising a cup at least partially disposed within the propulsion system housing, wherein the cup defines a cavity at least partially axially aligned with the opening of the housing, and wherein the conductor is at least partially disposed within the cavity.

24. The deployment unit of claim 23, wherein the cap cooperates with the cup to form a barrier covering the cavity of the cup.

25. The deployment unit of claim 24, wherein the cap comprises a cap protrusion and a cap groove, wherein the cup comprises a cup protrusion and a cup groove, and wherein the cap protrusion cooperates with the cup groove and the cup protrusion cooperates with the cap groove to at least partially form the barrier.

26. The deployment unit of claim 25, wherein the cap protrusion cooperates with the cup groove and the cup protrusion cooperates with the cap groove to at least one of axially seal and radially seal the cavity of the cup.

* * * * *